US011744362B1

(12) United States Patent
Floarea et al.

(10) Patent No.: US 11,744,362 B1
(45) Date of Patent: Sep. 5, 2023

(54) ADJUSTABLE AND STOWABLE STORAGE SHELF FOR A STORAGE ENCLOSURE

(71) Applicant: GM Global Technology Operations LLC, Detroit, MI (US)

(72) Inventors: George Floarea, Waterloo (CA); Radu Dragos Sotir, Richmond Hill (CA); Chris Wisniewski, Oshawa (CA)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 17/824,246

(22) Filed: May 25, 2022

(51) Int. Cl.

| | |
|---|---|
| ***A47B 45/00*** | (2006.01) |
| ***A47B 57/48*** | (2006.01) |
| ***A47B 57/04*** | (2006.01) |
| ***A47B 43/00*** | (2006.01) |
| ***A47B 47/02*** | (2006.01) |
| ***A47B 96/02*** | (2006.01) |
| ***A47B 47/00*** | (2006.01) |

(52) U.S. Cl.
CPC ..... *A47B 45/00* (2013.01); *A47B 43/00* (2013.01); *A47B 47/0083* (2013.01); *A47B 47/024* (2013.01); *A47B 57/04* (2013.01); *A47B 57/485* (2013.01); *A47B 96/021* (2013.01)

(58) Field of Classification Search
CPC ..... A47B 45/00; A47B 43/00; A47B 57/04; A47B 57/485; A47B 47/0083; A47B 47/02; A47B 47/021; A47B 47/024; A47B 47/028; A47B 96/02; A47B 96/021; A47B 96/025; A47F 5/0043; A47F 5/0081; A47F 5/10; A47F 5/108
USPC .... 211/149, 150, 197, 85.24, 191, 192, 187; 108/44, 163, 168, 172, 179, 181, 134; 105/371, 372; 296/24.44
See application file for complete search history.

(56) References Cited

U.S. PATENT DOCUMENTS 656,462 A * 8/1900 Kirby ..... B61D 27/0081 62/328
870,835 A * 11/1907 Loew ..... A47F 5/0025 211/74
1,351,125 A * 8/1920 Rex ..... B61D 45/006 105/372
1,778,277 A * 10/1930 Saville ..... B60P 3/007 296/24.44
2,149,015 A * 2/1939 Giddings ..... B61D 27/0081 105/372
2,249,234 A * 7/1941 Srodulski ..... G07F 9/10 211/184
3,612,288 A * 10/1971 Lesley ..... A47F 5/0087 108/2

(Continued)

*Primary Examiner* — Jennifer E. Novosad
(74) *Attorney, Agent, or Firm* — Cantor Colburn LLP

(57) ABSTRACT

A storage enclosure includes a first support member spaced from a second support member. The first support member includes a first rotating shelf support and the second support member includes a second rotating shelf support. A third support member is spaced from a fourth support member. The third support member includes a first fixed shelf support and a second fixed shelf support and the fourth support member includes a third fixed shelf support and a fourth fixed shelf support. A shelf includes a first end connected to the first rotating shelf support and the second rotating shelf support and a second end. The shelf is positionable in a first configuration and a second configuration.

20 Claims, 8 Drawing Sheets

(56) References Cited

U.S. PATENT DOCUMENTS 3,677,203 A * 7/1972 Barrineau ..... A47F 5/0087 108/166
3,861,768 A * 1/1975 Wilson ..... B62B 3/186 280/33.996
3,897,971 A * 8/1975 Evans ..... B60P 7/14 296/24.44
3,911,832 A * 10/1975 Vandergrift ..... B60P 7/00 296/24.44
3,953,044 A * 4/1976 Wilson ..... B62B 3/186 280/33.996
4,995,322 A * 2/1991 Frederick ..... A47B 5/06 108/38
5,042,863 A * 8/1991 Fraga ..... B60P 1/00 296/24.44
5,131,547 A * 7/1992 Goldberg ..... A47F 5/13 108/177
5,375,534 A * 12/1994 Adams ..... B62D 33/042 211/1.3
5,445,280 A * 8/1995 Rahn ..... A47F 5/16 211/186
5,452,972 A * 9/1995 Adams ..... B60P 7/135 292/121
5,542,758 A * 8/1996 Brown ..... A47B 61/00 211/85.3
5,899,346 A * 5/1999 Newkirk ..... A47B 43/00 211/150
6,123,207 A * 9/2000 Mast ..... B62B 3/025 211/149
6,223,913 B1 * 5/2001 Mosher ..... B60P 7/15 224/543
6,382,435 B1 * 5/2002 Legaz ..... B62B 3/025 211/175
6,585,306 B1 * 7/2003 Smith ..... B60P 1/00 296/24.44
6,848,371 B2 * 2/2005 Zheng ..... A47B 43/02 108/165
7,080,640 B2 * 7/2006 Sanders ..... A47J 33/00 126/30
7,293,813 B2 * 11/2007 Squyres ..... B60P 1/00 16/361
7,389,887 B2 * 6/2008 Liang ..... A47B 43/00 211/149
8,523,197 B2 * 9/2013 Baatz ..... B62B 3/025 280/42
8,616,388 B2 * 12/2013 Butler ..... A47B 43/00 108/106
8,672,147 B2 * 3/2014 Lam ..... A47F 7/18 211/85.3
9,226,574 B1 * 1/2016 Chen ..... A47B 96/07
9,901,169 B1 * 2/2018 Schenker ..... A47B 47/0058
10,058,171 B2 * 8/2018 Deng ..... A47B 96/021
10,182,650 B1 * 1/2019 Schenker ..... A47B 43/00
10,244,863 B2 * 4/2019 Grappe ..... A47B 96/021
11,008,164 B2 * 5/2021 Liu ..... A47F 5/10
2004/0238469 A1 * 12/2004 Ng ..... B62B 3/02 108/167
2005/0011845 A1 * 1/2005 Ernst ..... A47F 5/16 211/150
2011/0031200 A1 * 2/2011 Chen ..... A47B 43/00 211/149
2015/0366338 A1 * 12/2015 Conod ..... A47B 47/0083 108/48

* cited by examiner

ADJUSTABLE AND STOWABLE STORAGE SHELF FOR A STORAGE ENCLOSURE

INTRODUCTION

The subject disclosure relates to the art of storage enclosures and, more particularly, to an adjustable and stowable storage shelf for a storage enclosure.

Storage enclosures are set up to support articles for a wide number of uses. For example, a storage enclosure may support articles waiting on transport, articles being offered for sale, and/or articles waiting on pickup as well as articles in mobile enclosures being transported from one point to another. The number of uses for a storage enclosure is nearly endless. A typical storage enclosure includes one or more shelves for supporting articles. The shelves are often vertically height adjustable so as to accommodate a wide range of article sizes.

In many cases, the storage enclosure is built to support a large number of articles and/or heavy articles. In order to accommodate taller objects sometimes the shelves require adjustment or removal. That is, the removed shelf must be stored for later re-installation into the storage enclosure. Accordingly, it is desirable to provide a storage enclosure having a shelf that may be easily vertically height adjusted and/or removed without the need for storage.

SUMMARY

In a non-limiting example, a storage enclosure includes a first pair of vertical supports including a first support member spaced from a second support member along a horizontal axis. The first support member includes a first rotating shelf support and the second support member includes a second rotating shelf support. A second pair of vertical supports includes a third support member spaced from a fourth support member along the horizontal axis. The third support member includes a first fixed shelf support and a second fixed shelf support and the fourth support member including a third fixed shelf support and a fourth fixed shelf support. A shelf is selectively supported between the first and second pairs of vertical supports. The shelf includes a first end connected to the first rotating shelf support and the second rotating shelf support and a second end that is opposite the first end, the shelf being positionable in a first configuration wherein the second end is supported at the first fixed shelf support and the third fixed shelf support and a second configuration in which the first end of the shelf is rotated relative to the first pair of vertical supports in a first direction and the second end of the shelf is supported by the second fixed shelf support and the fourth fixed shelf supports.

In addition to one or more of the features described herein the shelf is selectively positionable in a third configuration in which the second end is unsupported.

In addition to one or more of the features described herein the each of the first support member and the second support member includes a first stop member and a second stop member, wherein each of the first rotating shelf support and the second rotating shelf support is positioned between the first stop member and the second stop member on each of the first support member and the second support member.

In addition to one or more of the features described herein each of the first rotating shelf support and the second rotating shelf support includes a hinge pin having an axis of rotation defined between the first stop member and the second stop member.

In addition to one or more of the features described herein the shelf includes a first side extending between the first end and the second end and a second side, opposite the first side, extending between the first end and the second end, the shelf including a first rod element arranged at the second end, the first rod element including a first terminal end and a second terminal end, each of the first and second terminal ends projecting outwardly of the first side and the second side respectively.

In addition to one or more of the features described herein the first fixed shelf support includes an upper surface, a forward surface, a lower surface, and an opening disposed opposite the forward surface, the opening being receptive of the first terminal end.

In addition to one or more of the features described herein the third fixed shelf support includes an upper surface portion, a forward surface portion, a lower surface portion, and an opening portion disposed opposite the forward surface portion, the opening portion being receptive of the second terminal end.

In addition to one or more of the features described herein the upper surface portion includes a first length and the lower surface portion includes a second length that is longer than the first length, the lower surface portion.

In addition to one or more of the features described herein the shelf includes a hinge including a rotational axis that extends between the first side and the second side, the shelf being foldable about the hinge.

In addition to one or more of the features described herein the shelf includes a first shelf portion including a first rod defining the first end and a second rod arranged at a mid-section of the shelf and a second shelf portion including the first rod element defining the second end and a second rod element arranged at the mid-section, the hinge being arranged between the second rod and the second rod element.

In addition to one or more of the features described herein the first shelf portion includes a plurality of connecting members that extend between the first rod and the second rod, and the second shelf portion including a plurality of connecting elements that extend between the first rod element and the second rod element, each of the plurality of connecting members selectively engaging the second rod element and each of the plurality of connecting elements selectively engaging the second rod.

In addition to one or more of the features described herein each of the plurality of connecting members includes a hook that selectively engages the second rod element and each of the plurality of connecting elements includes a hook element that selectively engages the first rod.

In addition to one or more of the features described herein the hinge includes a first pin connecting one of the plurality of connecting members and one of the plurality of connecting elements defining the first side, and a second pin connecting one of the plurality of connecting members and one of the plurality of connecting elements defining the second side.

In addition to one or more of the features described herein the rotational axis is disposed between the second rod and the second rod element.

In addition to one or more of the features described herein the first rod is connected to the first rotating shelf support and the second rotating shelf support.

A method of reconfiguring a storage enclosure, in accordance with a non-limiting example, includes rotating a first end of a shelf pivotally supported by a first pair of vertical supports, unseating a second end of the shelf from a first fixed shelf support and a third fixed shelf support provided on a second pair of vertical supports, and supporting the second end of the shelf in a second fixed shelf support and a fourth fixed shelf support provided on the second pair of vertical supports and vertically offset from the first fixed shelf support and the second fixed shelf support.

In addition to one or more of the features described herein rotating the first end of the shelf includes pivoting the first end of the shelf from a first stop member provided on each of the first pair of vertical supports to a second stop member provided on each of the second pair of vertical supports.

In addition to one or more of the features described herein unseating the second end includes folding the shelf about an axis that extends substantially parallel to each of the first end and the second end.

In addition to one or more of the features described herein the method includes transitioning the shelf to a storage configuration whereby the first end is supported by the first pair of vertical supports and the second end of the shelf is unsupported.

In addition to one or more of the features described herein transitioning the shelf to the storage configuration includes folding the shelf about a hinge having an axis of rotation that extends parallel to the first end and the second end and supporting the hinge and the first end at the first pair of vertical supports.

The above features and advantages, and other features and advantages of the disclosure are readily apparent from the following detailed description when taken in connection with the accompanying drawings.

BRIEF DESCRIPTION OF THE DRAWINGS

Other features, advantages and details appear, by way of example only, in the following detailed description, the detailed description referring to the drawings in which.

DETAILED DESCRIPTION

Figure 1:
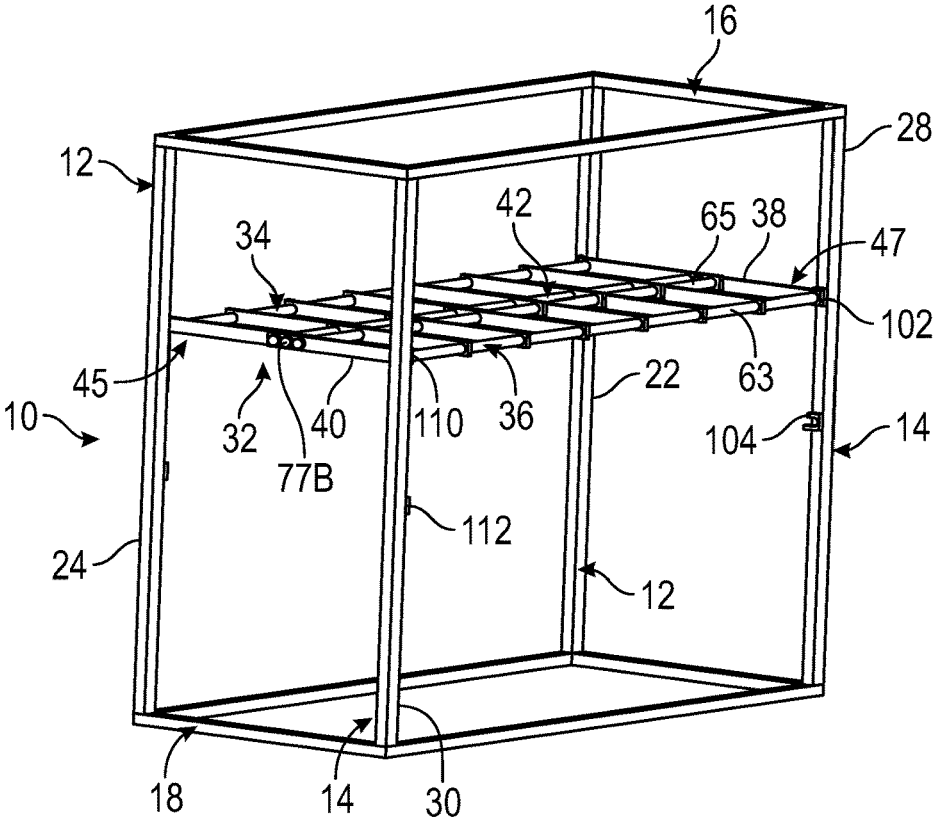
FIG. 1 is a perspective view of a shelf enclosure including an adjustable and stowable shelf in a first configuration, in accordance with a non-limiting example.

The following description is merely exemplary in nature and is not intended to limit the present disclosure, its application or uses. It should be understood that throughout the drawings, corresponding reference numerals indicate like or corresponding parts and features.

A storage enclosure, in accordance with a non-limiting example, is indicated generally at 10 in FIG. 1. Storage enclosure 10 includes a first pair of vertical supports 12 and a second pair of vertical supports 14. First and second pairs of vertical supports 12 and 14 are joined by an upper frame 16 and a lower frame 18. In a non-limiting example, first pair of vertical supports 12 includes a first support member 22 and a second support member 24. Second pair of vertical supports 14 includes a third support member 28 and a fourth support member 30.

Figure 2:
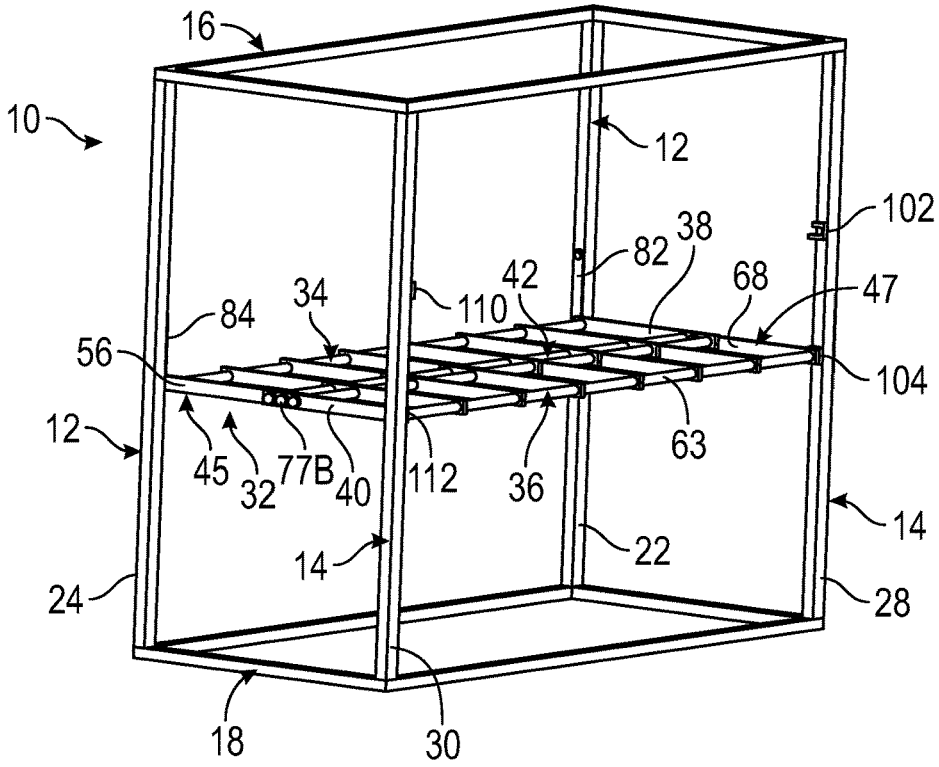
FIG. 2 is a perspective view of a shelf enclosure including an adjustable and stowable shelf in a second configuration, in accordance with a non-limiting example.
Figure 4:
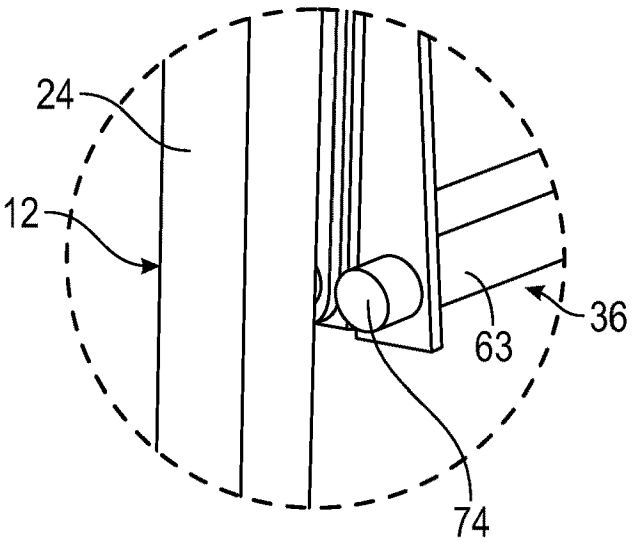
FIG. 4 is a detail view of the circled section 4 in FIG. 3, in accordance with a non-limiting example.
Figure 3:
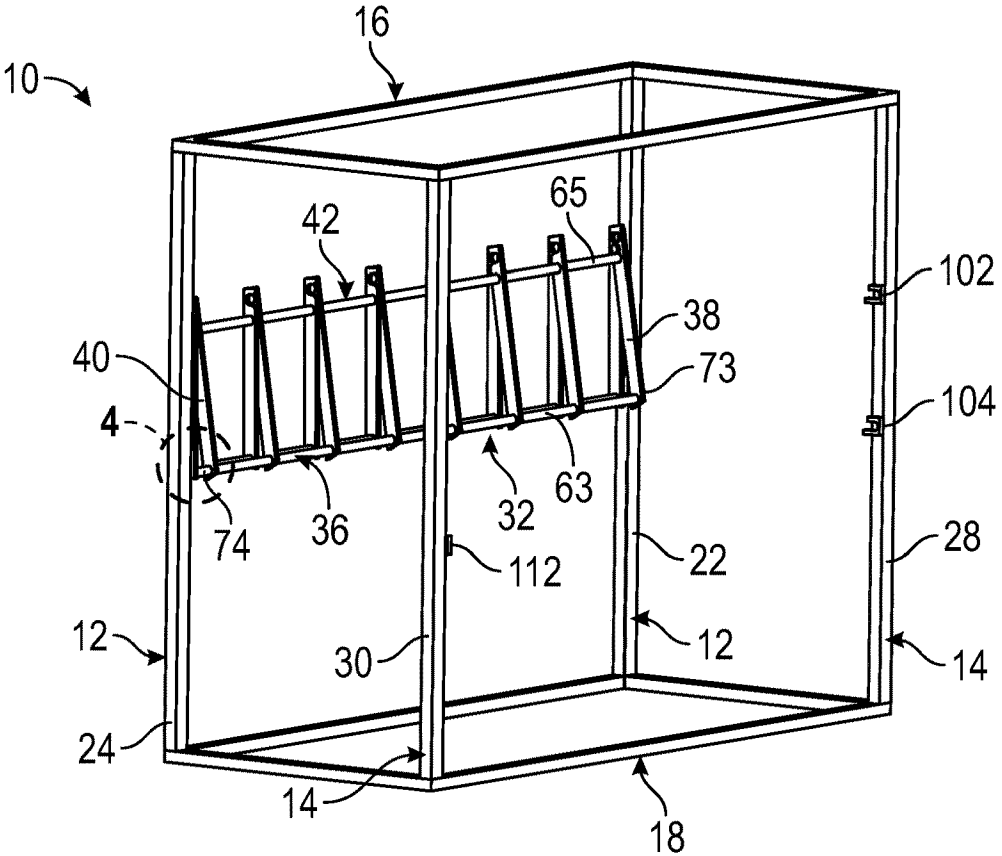
FIG. 3 is a perspective view of a shelf enclosure including an adjustable and stowable shelf in a third configuration, in accordance with a non-limiting example.

A shelf 32 is supported between first and second pairs of vertical supports 12 and 14. As will be detailed herein, shelf 32 is selectively positionable so as to establish various storage and/or stowed configurations. For example, shelf 32 may be arranged in an upper configuration (FIG. 1), a lower configuration (FIG. 2) or a stowed configuration (FIG. 3)

Figure 5:
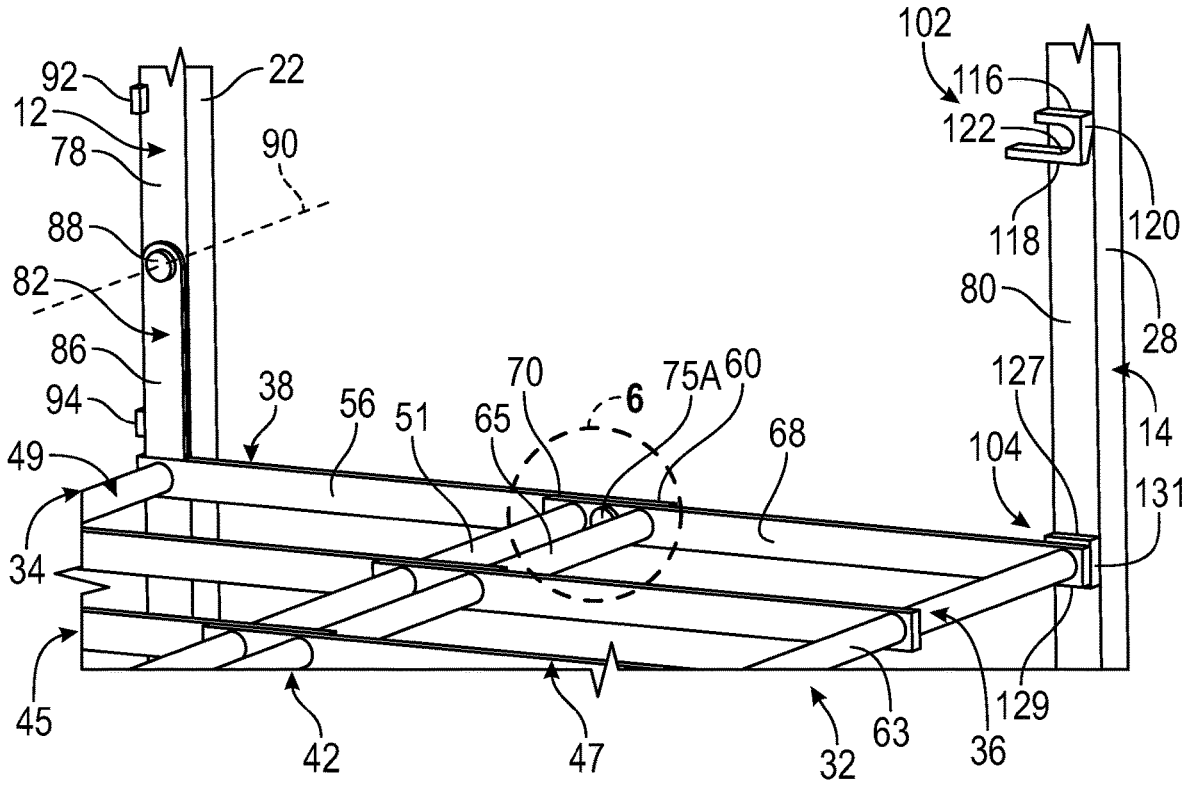
FIG. 5 is a partial perspective view of the shelf enclosure showing the shelf in the second configuration, in accordance with a non-limiting example.

Shelf 32 includes a first end 34 supported by first pair of vertical supports 12 and a second end 36 supported by second pair of vertical supports 14. Second end 36 is opposite to first end 34. Shelf 32 also includes a first side 38 and a second side 40. Second side 40 is opposite to first side 38. Shelf 32 includes a mid-section 42 as shown in FIG. 5. Mid-section 42 separates shelf 32 into a first shelf portion 45 and a second shelf portion 47. As will be detailed herein, shelf 32 may pivot about mid-section 42.

Figure 6:
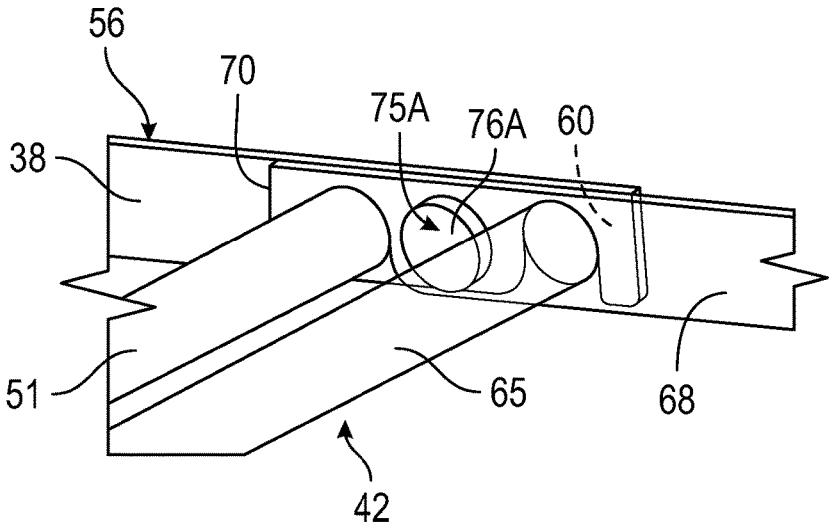
FIG. 6 is a detail view of the circled section 6 in FIG. 5, in accordance with a non-limiting example.
Figure 7:
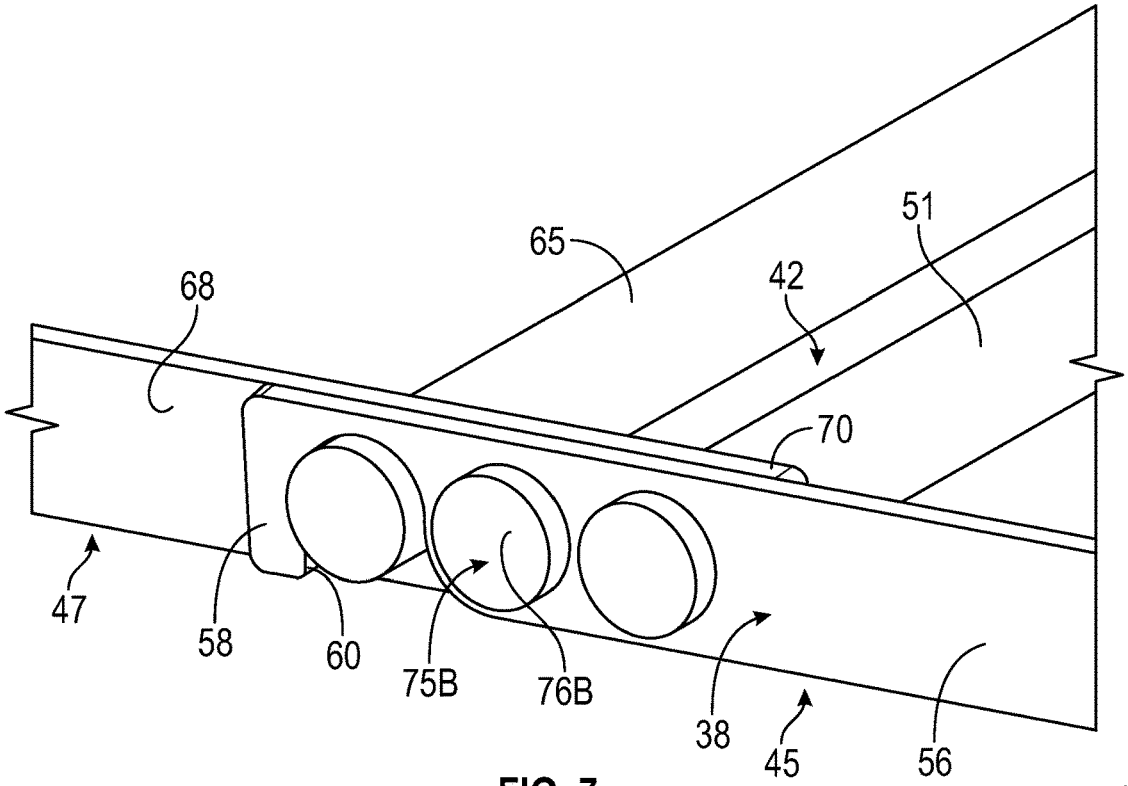
FIG. 7 is a partial perspective view of the shelf of FIG. 1 in a first orientation, in accordance with a non-limiting example.

As shown in FIG. 5, first shelf portion 45 includes a first rod 49 that extends between first pair of vertical supports 12 and a second rod 51 at mid-section 42. First shelf portion 45 includes a plurality of connecting members 56 that extend between first rod 49 and second rod 51. As shown in FIGS. 6 and 7, each connecting member 56 includes a terminal end 58 having a hook 60 (FIG. 6) disposed outwardly of second rod 51. In a non-limiting example, second shelf portion 47 includes a first rod element 63 that extends between second pair of vertical supports 14 and a second rod element 65 arranged at mid-section 42.

Figure 8:
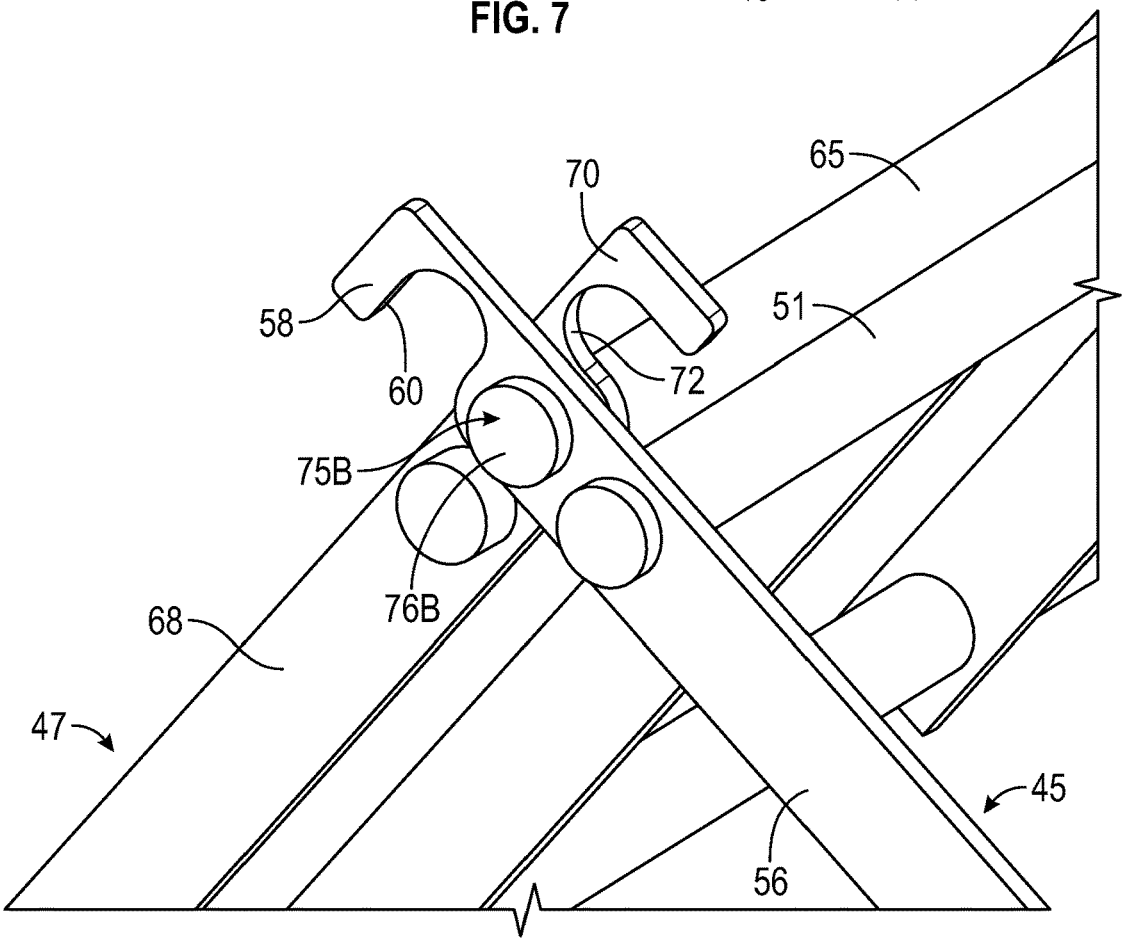
FIG. 8 is a partial perspective view of the shelf of FIG. 7 in a second orientation, in accordance with a non-limiting example.

Second shelf portion 47 includes a plurality of connecting elements 68 that extend from first rod element 63 to second rod element 65. As shown in FIG. 8, each connecting element 68 includes a terminal end 70 supporting a hook element 72 that extends outwardly of second rod element 65. As shown in FIG. 3, first rod element 63 includes a first terminal end 73 and a second terminal end 74 that project outwardly of first side 38 and second side 40 respectively.

As shown in FIG. 5, first shelf portion 45 is coupled to second shelf portion 47 at mid-section 42 through a first hinge 75A. First hinge 75A takes the form of a first pin 76A (FIG. 8) that is disposed between second rod 51 and second rod element 65. Pin 76A connects one of the plurality of connecting members 56 and one of the plurality of connecting elements 68 that form at first side 38. A second hinge 75B in the form of a second pin 76B (FIG. 2) connects one of the plurality of connecting members 56 and one of the plurality of connecting elements 68 that form second side 40. Each hook 60 engages second rod element 65 and each hook element 72 engages second rod 51 to lock first shelf portion 45 to second shelf portion 47 as shown in FIG. 7.

With continued reference to FIG. 5, first support member 22 includes an inner surface 78 and third support member 28 includes an inner surface portion 80. It should be understood that second support member 24 and fourth support member 30 include similar structure. A first rotating shelf support 82 is pivotally mounted to inner surface 78 of first support member 22. A second rotating shelf support 84 (FIG. 2) is pivotally supported to second support member 24. First end 34 of shelf 32 is coupled between first and second rotating shelf supports 82 and 84.

First rotating shelf support 82 includes a bar or link 86 that is pivotally connected to inner surface 78 of first support member 22 by a pin 88. Pin 88 defines a pivot axis 90 for bar 86. Bar 86 rotates between a first stop member 92 defining the upper configuration for shelf 32 and a second stop member 94 defining the lower configuration for shelf 32 as well as the stowed configuration. In a non-limiting example, third support member 28 includes a first fixed shelf support 102 and a second fixed shelf support 104. Fourth support member 30 includes a third fixed shelf support 110 and a fourth fixed shelf support 112.

In the upper configuration, first and second rotating shelf supports 82 and 84 are rotated upwardly to engage stop member 92 and second end 36 of shelf 32 is supported by first and third fixed shelf supports 102 and 110. In the lower configuration, first and second rotating shelf supports 82 and 84 are rotated downwardly to engage stop member 94 and second end 36 of shelf 32 is supported between second and fourth fixed shelf supports 104 and 112. Reference will now follow to FIG. 5 in describing first fixed shelf support 102 with an understanding that second, third, and fourth fixed shelf supports 104, 110, and 112 are similarly formed. First fixed shelf support 102 includes an upper surface 116, a lower surface 118 and a forward surface 120. A C-shaped opening 122 is defined between upper surface and lower surface 118. In a non-limiting example, lower surface 118 is longer than upper surface 116.

Figure 9A:
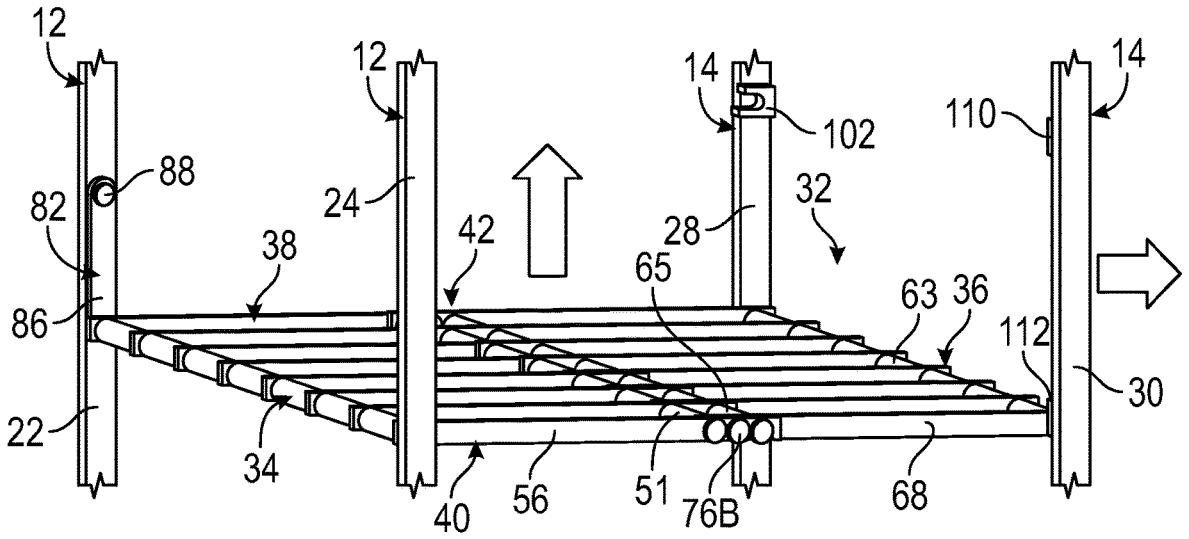
FIG. 9A is a partial perspective view of the shelf enclosure of FIG. 2 illustrating the shelf in the second configuration, in accordance with a non-limiting example.
Figure 9B:
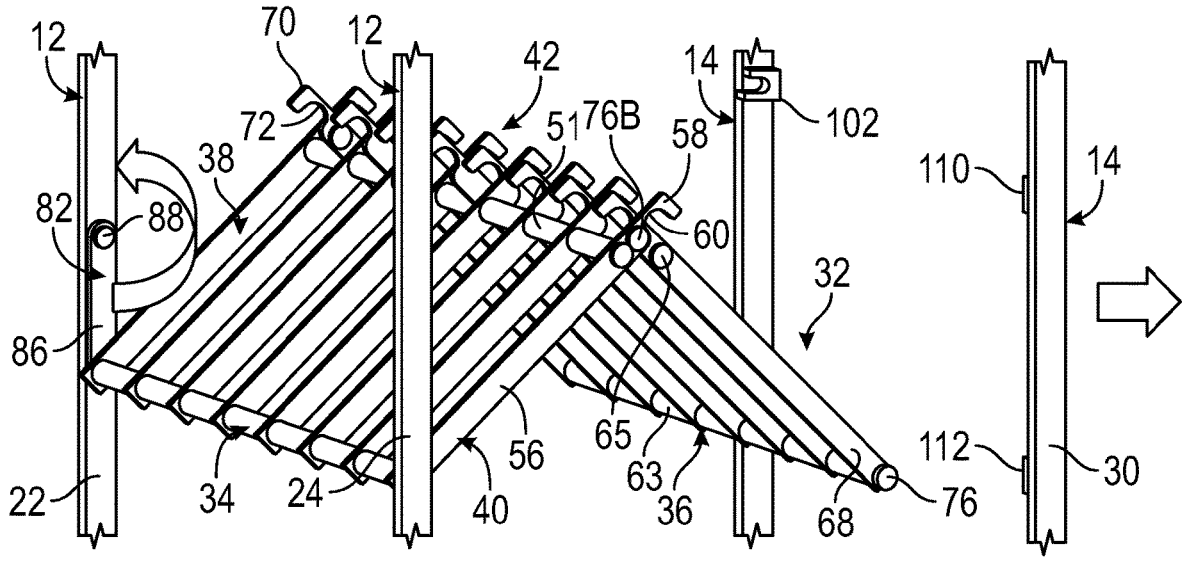
FIG. 9B is a partial perspective view of the shelf enclosure of FIG. 9A depicting the shelf transitioning to the first configuration, in accordance with a non-limiting example.
Figure 9C:
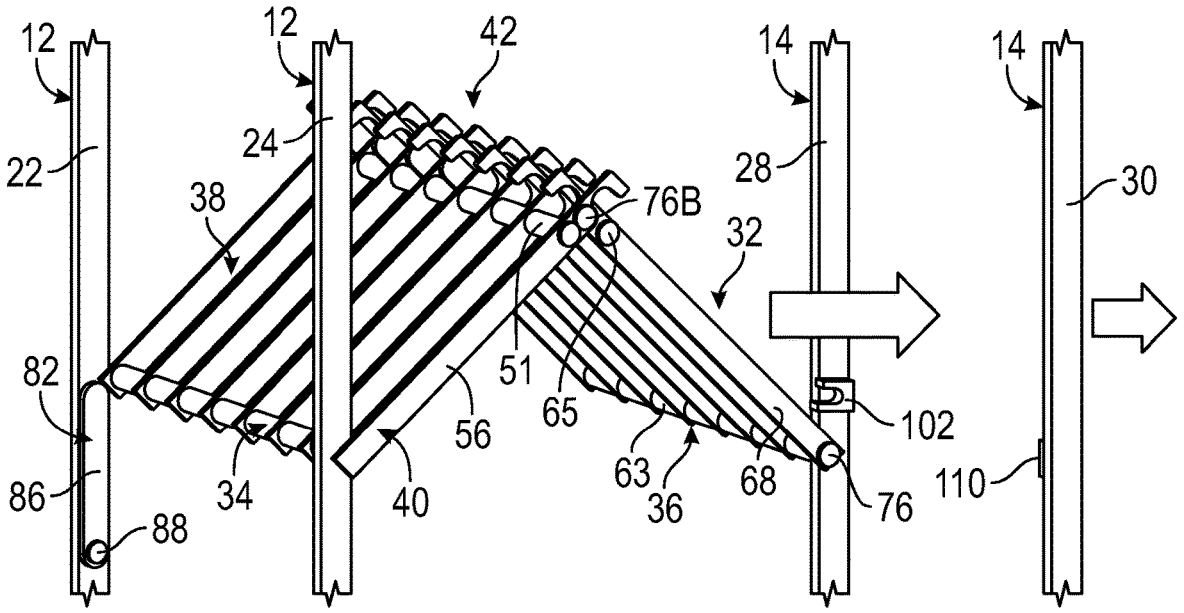
FIG. 9C is a partial perspective view of the shelf enclosure of FIG. 9B illustrating the shelf being deployed in the first configuration, in accordance with a non-limiting example.
Figure 9D:
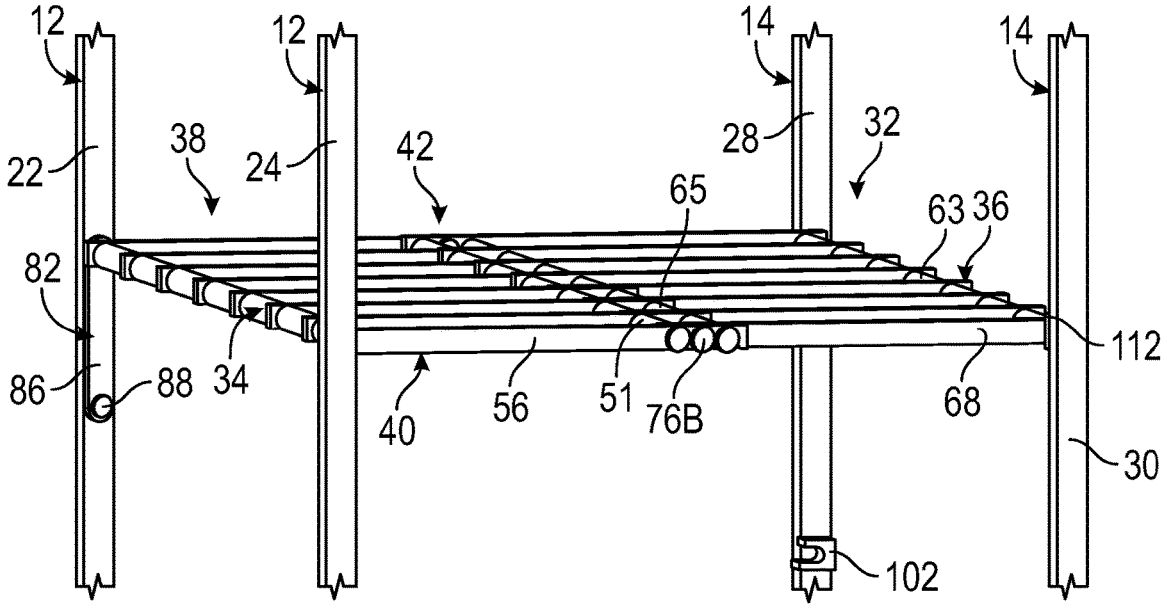
FIG. 9D is a partial perspective view of the shelf enclosure of FIG. 9C illustrating the shelf in the first configuration, in accordance with a non-limiting example.

Reference will now follow to FIGS. 9A-9D in describing a method of shifting shelf 32 from the lower configuration to the upper configuration in accordance with a non-limiting example. In the lower configuration (FIG. 9A), an upward force is applied to mid-section 42. Shelf 32 folds about hinge 75 as shown in FIG. 7B such that hook 60 and hook element 72 disengage from second rod 51 and second rod element 65 respectively. While folding, first rod element 63 disengages from second fixed shelf support 104 and fourth fixed shelf support 112. Shelf 32 may then be raised by pivoting first and second rotating shelf supports 82 and 84 upwardly as shown in FIG. 9C. At this point, shelf 32 may be unfolded such that hook 60 and hook element 72 re-engage with second rod 51 and second rod element 65 respectively and first rod element 63 is supported by first fixed support 102 and third fixed support 110 as shown in FIG. 9D.

Figure 10A:
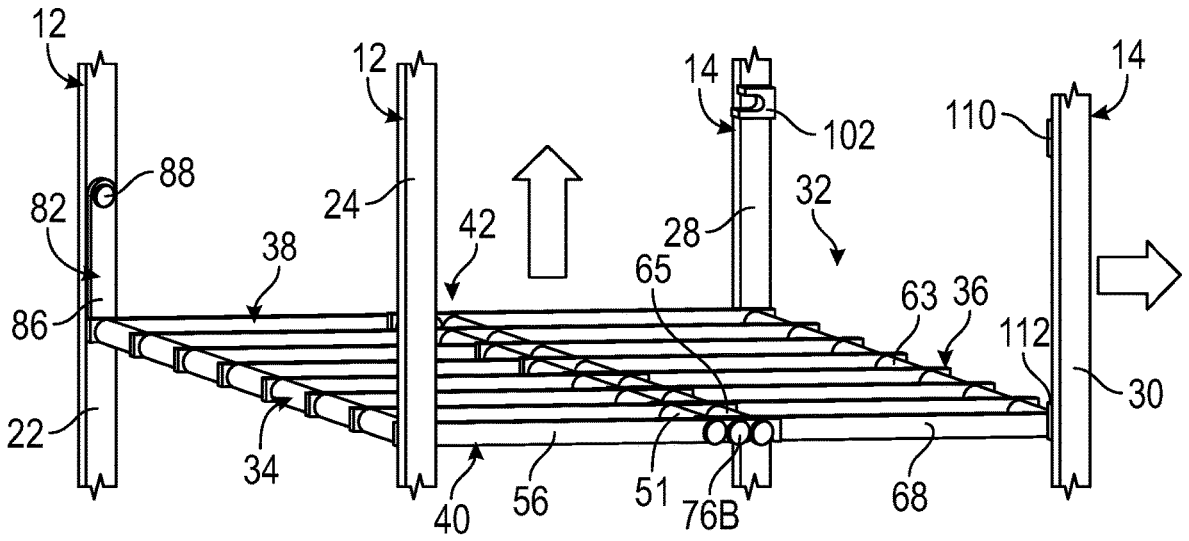
FIG. 10A is a partial perspective view of the shelf enclosure of FIG. 2 illustrating the shelf in the second configuration, in accordance with a non-limiting example
Figure 10B:
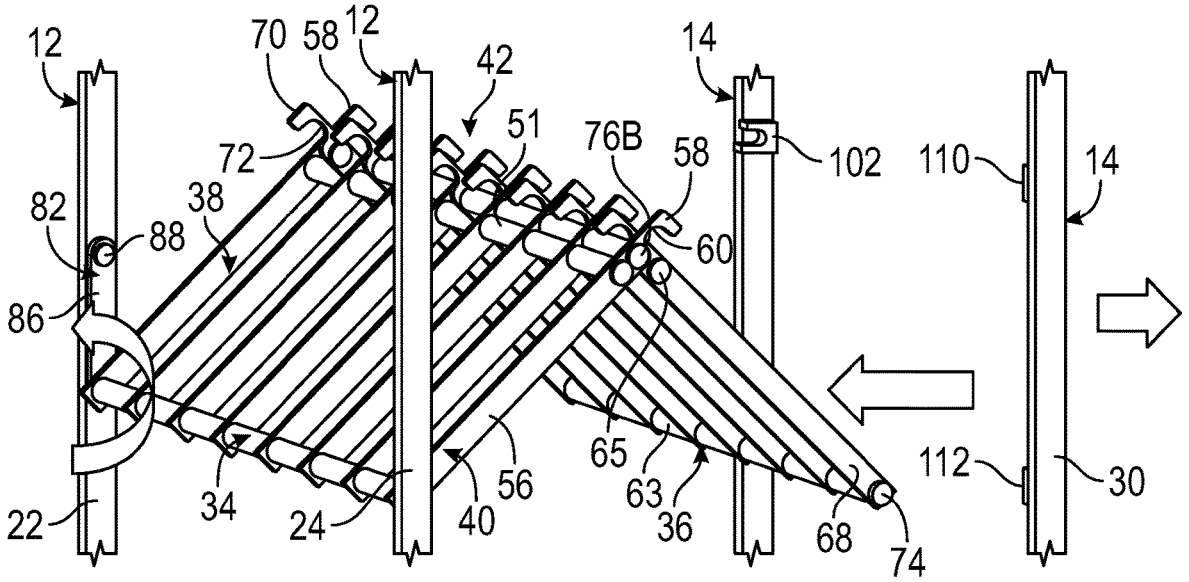
FIG. 10B is a partial perspective view of the shelf enclosure of FIG. 10A showing the shelf transitioning from the second configuration to the third configuration, in accordance with a non-limiting example.
Figure 10C:
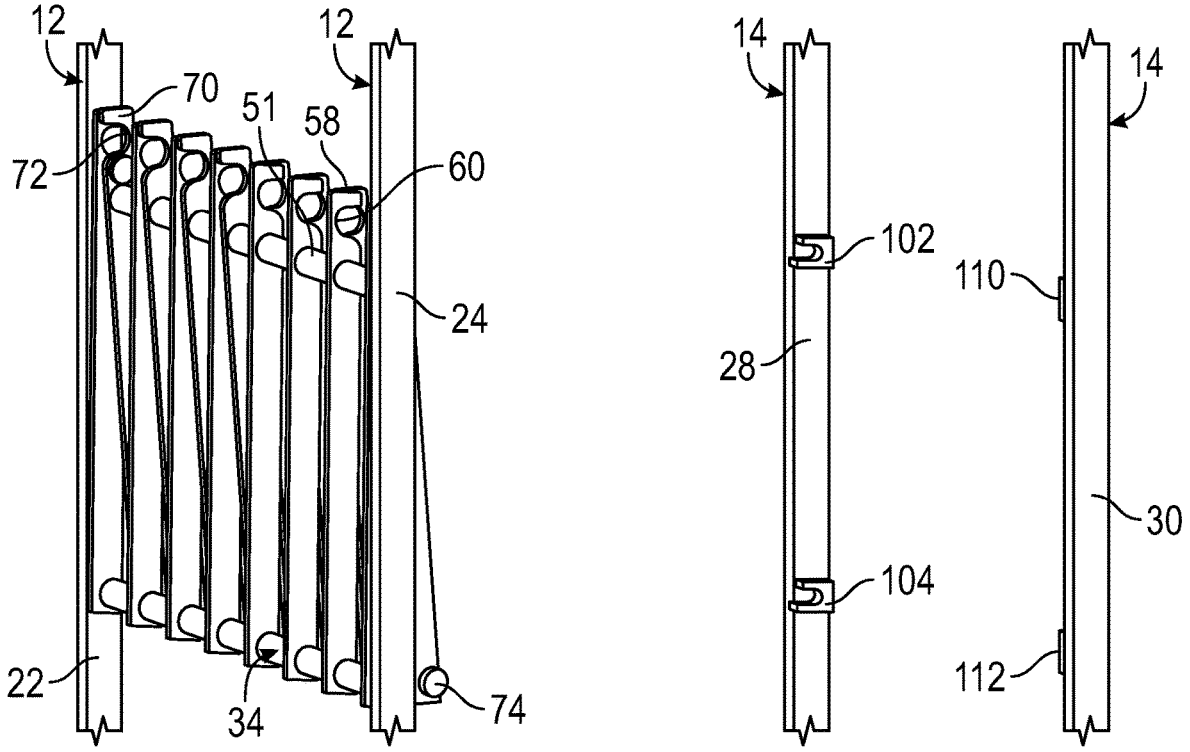
FIG. 10C is a partial perspective view of the shelf enclosure of FIG. 10B showing the shelf in the third configuration, in accordance with a non-limiting example.

Reference will follow to FIGS. 10A-10C in describing a method of shifting shelf 32 from the lower configuration to the stowed configuration. As shown in FIG. 10A, an upward force is applied to mid-section 42. Shelf 32 folds about hinge 75 as shown in FIG. 10B such that hook 60 and hook element 72 disengage from second rod 51 and second rod element 65 respectively. While folding, first rod element 63 disengages from second fixed shelf support 104 and fourth fixed shelf support 112. At this point, shelf 32 continues to be folded toward first support member 22 and second support member 24 as shown in FIG. 10B. Shelf 32 continues to fold until second shelf portion 47 is positioned against or near to first shelf portion 45 as shown in FIG. 10C. Shelf 32 may be held in a folded configuration by a locking mechanism (not shown) or allow to hang, unfolded.

At this point, it should be understood that the storage enclosure formed in accordance with the non-limiting examples described herein can be readily reconfigurable without the need to special tools or tools of any kind. Further, the storage enclosure may be readily reconfigured by a single individual. The storage enclosure may be set up with large lower storage zone, a smaller lower storage zone, or one large storage zone depending one what articles need storing.

While the above disclosure has been described with reference to exemplary embodiments, it will be understood by those skilled in the art that various changes may be made and equivalents may be substituted for elements thereof without departing from its scope. In addition, many modifications may be made to adapt a particular situation or material to the teachings of the disclosure without departing from the essential scope thereof Therefore, it is intended that the present disclosure not be limited to the particular embodiments disclosed, but will include all embodiments falling within the scope thereof

What is claimed is:

1. A storage enclosure comprising:

a first pair of vertical supports including a first support member spaced from a second support member along a horizontal axis, the first support member including a first rotating shelf support and the second support member including a second rotating shelf support;

a second pair of vertical supports including a third support member spaced from a fourth support member along the horizontal axis, the third support member including a first fixed shelf support and a second fixed shelf support and the fourth support member including a third fixed shelf support and a fourth fixed shelf support; and a shelf selectively supported between the first and second pairs of vertical supports, the shelf including a first end connected to the first rotating shelf support and the second rotating shelf support and a second end that is opposite the first end, the shelf being positionable in a first configuration wherein the second end is supported at the first fixed shelf support and the third fixed shelf support and a second configuration, in which the first end of the shelf is rotated relative to the first pair of vertical supports in a first direction and the second end of the shelf is supported by the second fixed shelf support and the fourth fixed shelf support.

2. The storage enclosure according to claim 1, wherein the shelf is selectively positionable in a third configuration in which the second end is unsupported.

3. The storage enclosure according to claim 1, wherein each of the first support member and the second support member includes a first stop member and a second stop member, wherein each of the first rotating shelf support and the second rotating shelf support is positioned between the first stop member and the second stop member on each of the first support member and the second support member.

4. The storage enclosure according to claim 3, wherein each of the first rotating shelf support and the second rotating shelf support includes a hinge pin having an axis of rotation defined between the first stop member and the second stop member.

5. The storage enclosure according to claim 1, wherein the shelf includes a first side extending between the first end and the second end and a second side, opposite the first side, extending between the first end and the second end, the shelf including a first rod element arranged at the second end, the first rod element including a first terminal end and a second terminal end, each of the first and second terminal ends projecting outwardly from the first side and the second side respectively.

6. The storage enclosure according to claim 5, wherein the first fixed shelf support includes an upper surface, a forward surface, a lower surface, and an opening disposed opposite the forward surface, the opening being receptive of the first terminal end.

7. The storage enclosure according to claim 6, wherein the third fixed shelf support includes an upper surface portion, a forward surface portion, a lower surface portion, and an opening portion disposed opposite the forward surface portion, the opening portion being receptive of the second terminal end.

8. The storage enclosure according to claim 7, wherein the upper surface portion includes a first length and the lower surface portion includes a second length that is longer than the first length.

9. The storage enclosure according to claim 5, wherein the shelf includes a hinge including a rotational axis that extends between the first side and the second side, the shelf being foldable about the hinge.

10. The storage enclosure according to claim 9, wherein the shelf includes a first shelf portion including a first rod defining the first end and a second rod arranged at a mid-section of the shelf and a second shelf portion including the first rod element defining the second end and a second rod element arranged at the mid-section, the hinge being arranged between the second rod and the second rod element.

11. The storage enclosure according to claim 10, wherein the first shelf portion includes a plurality of connecting members that extend between the first rod and the second rod, and the second shelf portion including a plurality of connecting elements that extend between the first rod element and the second rod element, each of the plurality of connecting members selectively engaging the second rod element and each of the plurality of connecting elements selectively engaging the second rod.

12. The storage enclosure according to claim 11, wherein each of the plurality of connecting members includes a hook that selectively engages the second rod element and each of the plurality of connecting elements includes a hook element that selectively engages the first rod.

13. The storage enclosure according to claim 11, wherein the hinge includes a first pin connecting one of the plurality of connecting members and one of the plurality of connecting elements defining the first side, and a second pin connecting one of the plurality of connecting members and one of the plurality of connecting elements defining the second side.

14. The storage enclosure according to claim 10, wherein the rotational axis is disposed between the second rod and the second rod element.

15. The storage enclosure according to claim 10, wherein the first rod is connected to the first rotating shelf support and the second rotating shelf support.

16. A method of reconfiguring a storage enclosure comprising:

shifting the reconfigurable storage enclosure from a first configuration by unseating a second end of the shelf from a first fixed shelf support and a third fixed shelf support provided on a second pair of vertical supports;

rotating a first end of a shelf pivotally supported by a first pair of vertical supports; and establishing a second configuration of the storage enclosure by supporting the second end of the shelf in a second fixed shelf support and a fourth fixed shelf support provided on the second pair of vertical supports and vertically offset from the first fixed shelf support and the third fixed shelf support.

17. The method of claim 16, wherein rotating the first end of the shelf includes pivoting the first end of the shelf from a first stop member provided on each of the first pair of vertical supports to a second stop member provided on each of the second pair of vertical supports.

18. The method of claim 16, wherein unseating the second end includes folding the shelf about an axis that extends substantially parallel to each of the first end and the second end.

19. The method of claim 16, further comprising: transitioning the shelf to a storage configuration whereby the first end is supported by the first pair of vertical supports and the second end of the shelf is unsupported.

20. The method of claim 19, wherein transitioning the shelf to the storage configuration includes folding the shelf about a hinge having an axis of rotation that extends parallel to the first end and the second end and supporting the hinge and the first end at the first pair of vertical supports.

* * * * *